US011524843B2

(12) United States Patent
Rothfarb

(10) Patent No.: US 11,524,843 B2
(45) Date of Patent: Dec. 13, 2022

(54) RUBBISH BIN LOCK ASSEMBLY

(71) Applicant: Andrew Rothfarb, Happauge, NY (US)

(72) Inventor: Andrew Rothfarb, Happauge, NY (US)

( * ) Notice: Subject to any disclaimer, the term of this patent is extended or adjusted under 35 U.S.C. 154(b) by 0 days.

(21) Appl. No.: 17/225,182

(22) Filed: Apr. 8, 2021

(65) Prior Publication Data

US 2022/0324641 A1 Oct. 13, 2022

(51) Int. Cl.
*B65D 55/10* (2006.01)
*B65F 1/16* (2006.01)

(52) U.S. Cl.
CPC ..... *B65F 1/1615* (2013.01); *B65F 2210/148* (2013.01)

(58) Field of Classification Search
CPC ... B65F 1/1615; B65F 2210/148; B65D 55/10
USPC ..... 220/315; 292/19, 26, 62, 237; 70/164
See application file for complete search history.

(56) References Cited

U.S. PATENT DOCUMENTS

| | | | | |
|---|---|---|---|---|
| 4,198,087 | A | 4/1980 | Cornell | |
| 5,599,050 | A * | 2/1997 | Tinsley | B65F 1/1615 292/210 |
| 6,722,709 | B2 | 4/2004 | Bergdoll | |
| 7,806,287 | B2 | 10/2010 | Rouns | |
| 9,303,439 | B2 | 4/2016 | Kreitzer | |
| 10,221,011 | B2 | 3/2019 | Stone | |
| 2007/0175898 | A1 | 8/2007 | Craft | |
| 2012/0273495 | A1 | 11/2012 | D'Alessandro | |
| 2017/0313510 | A1 | 11/2017 | Peckham | |

FOREIGN PATENT DOCUMENTS

| | | | | |
|---|---|---|---|---|
| CA | 2542229 | | 7/2007 | |
| GB | 342709 | * | 1/1931 | B65D 55/10 |

* cited by examiner

*Primary Examiner* — Don M Anderson
*Assistant Examiner* — Elizabeth J Volz

(57) ABSTRACT

A rubbish bin lock assembly includes a rubbish bin that has a lid is hingedly to a top end of the rubbish bin for opening and closing the rubbish bin. A plurality of receivers is each attached to the rubbish bin. A rod is included which has a sequence of bends thereon thereby facilitating the rod to be positioned around the lid. A plurality of engagements is each integrated into the rod and each of the engagements releasably engages a respective one of the receivers when the lid is in a closed position. In this way the lid is inhibited from being opened by animals from opening the lid. Additionally, each of the engagements disengages the respective receiver when the rod is urged into an unlocked position thereby facilitating the lid to be opened.

7 Claims, 6 Drawing Sheets

RUBBISH BIN LOCK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to rubbish bin devices and more particularly pertains to a new rubbish bin device for locking a lid on a rubbish bin. The device includes a rod that is slidably coupled to a lid of a rubbish bin and a plurality of receivers that are coupled to the rubbish bin. The rod is biased to engage each of the receivers for locking the lid in a closed position and the rod can be urged into an unlocked position for unlocking the lid.

(2) Description of Related Art Including Information Disclosed Under 37 CFR 1.97 and 1.98

The prior art relates to rubbish bin devices including a variety of bin locks that includes a member which extends across a lid of a bin for locking the lid in a closed position. Additionally, the prior art discloses a variety of lid locks that have a sliding element which is laterally positioned on a lid of a bin. In no instance does the prior art disclose a lid lock that includes a rod that is slidably attached to a lid which engages receivers that are coupled to a rubbish bin for locking the lid.

BRIEF SUMMARY OF THE INVENTION

An embodiment of the disclosure meets the needs presented above by generally comprising a rubbish bin that has a lid is hingedly to a top end of the rubbish bin for opening and closing the rubbish bin. A plurality of receivers is each attached to the rubbish bin. A rod is included which has a sequence of bends thereon thereby facilitating the rod to be positioned around the lid. A plurality of engagements is each integrated into the rod and each of the engagements releasably engages a respective one of the receivers when the lid is in a closed position. In this way the lid is inhibited from being opened by animals from opening the lid. Additionally, each of the engagements disengages the respective receiver when the rod is urged into an unlocked position thereby facilitating the lid to be opened.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
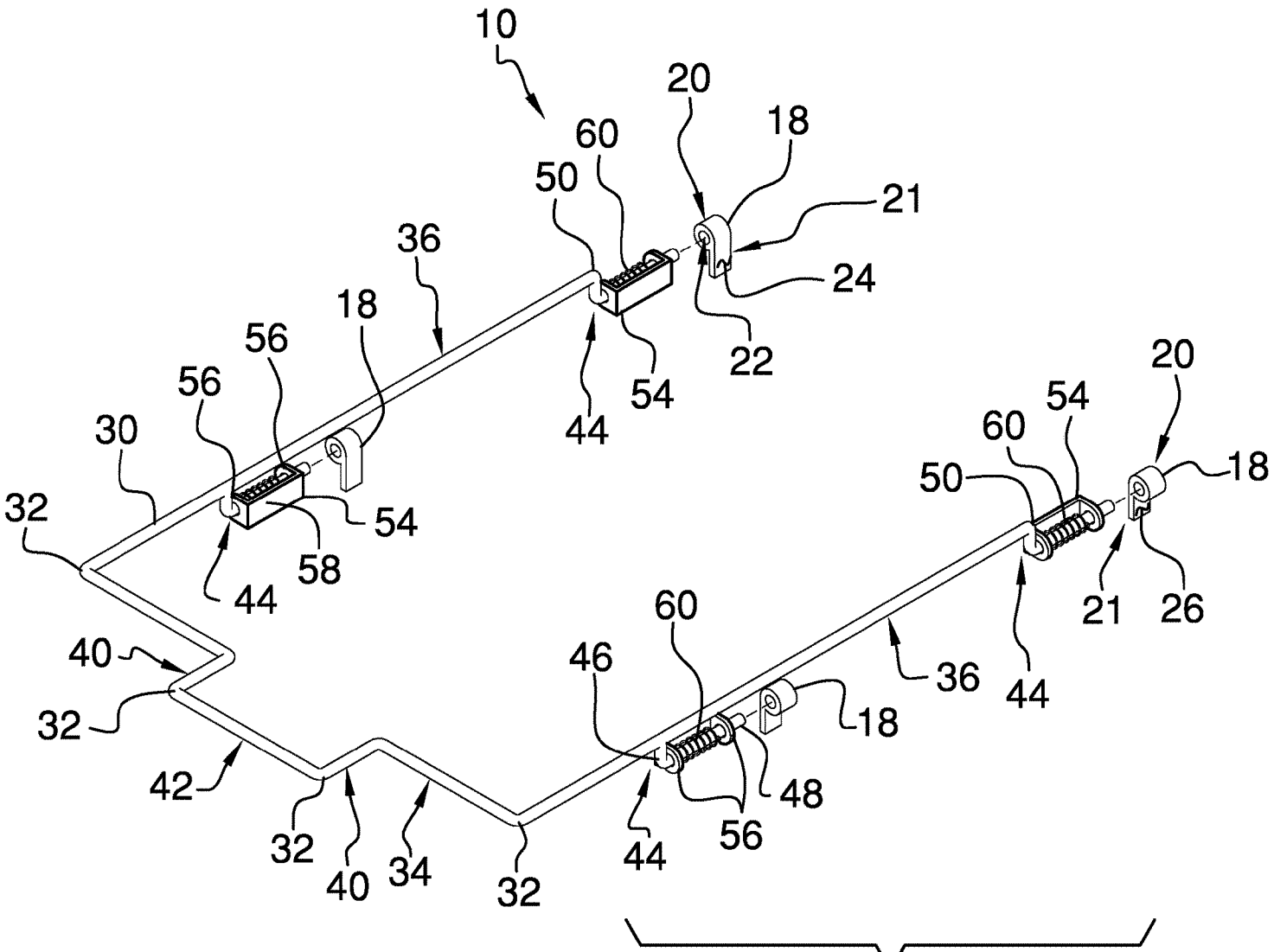
FIG. 1 is a perspective view of a rubbish bin lock assembly according to an embodiment of the disclosure.
Figure 2:
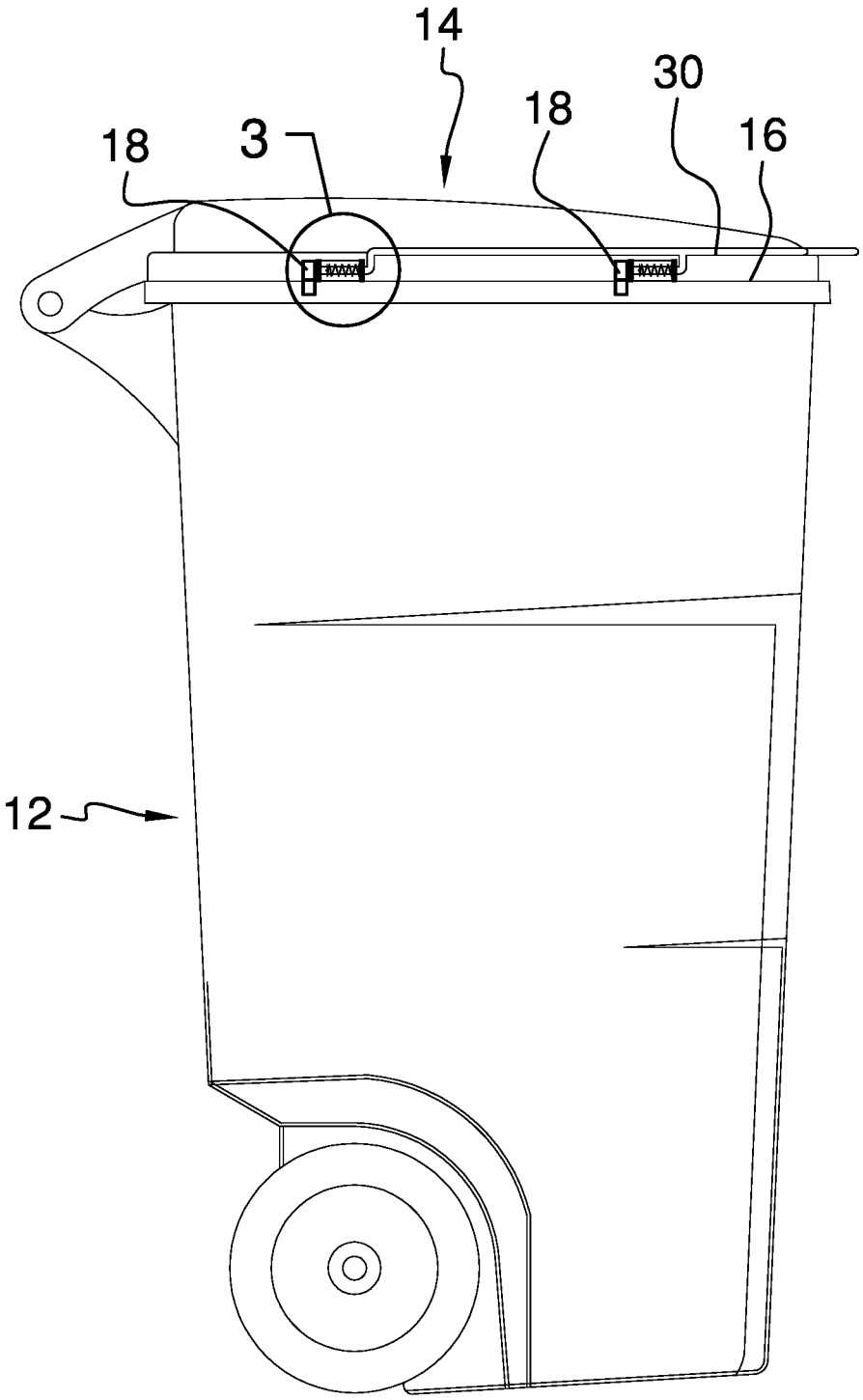
FIG. 2 is a right side in-use view of an embodiment of the disclosure showing a lid being locked.
Figure 3:
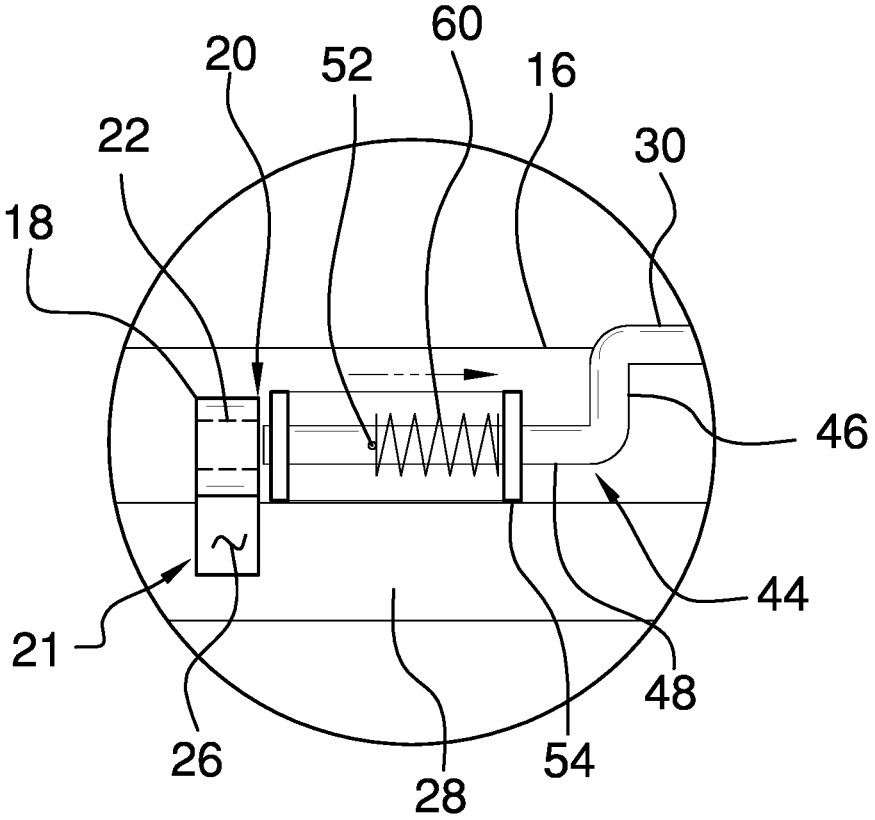
FIG. 3 is a detail view taken from circle 3 of FIG. 2 of an embodiment of the disclosure.
Figure 4:
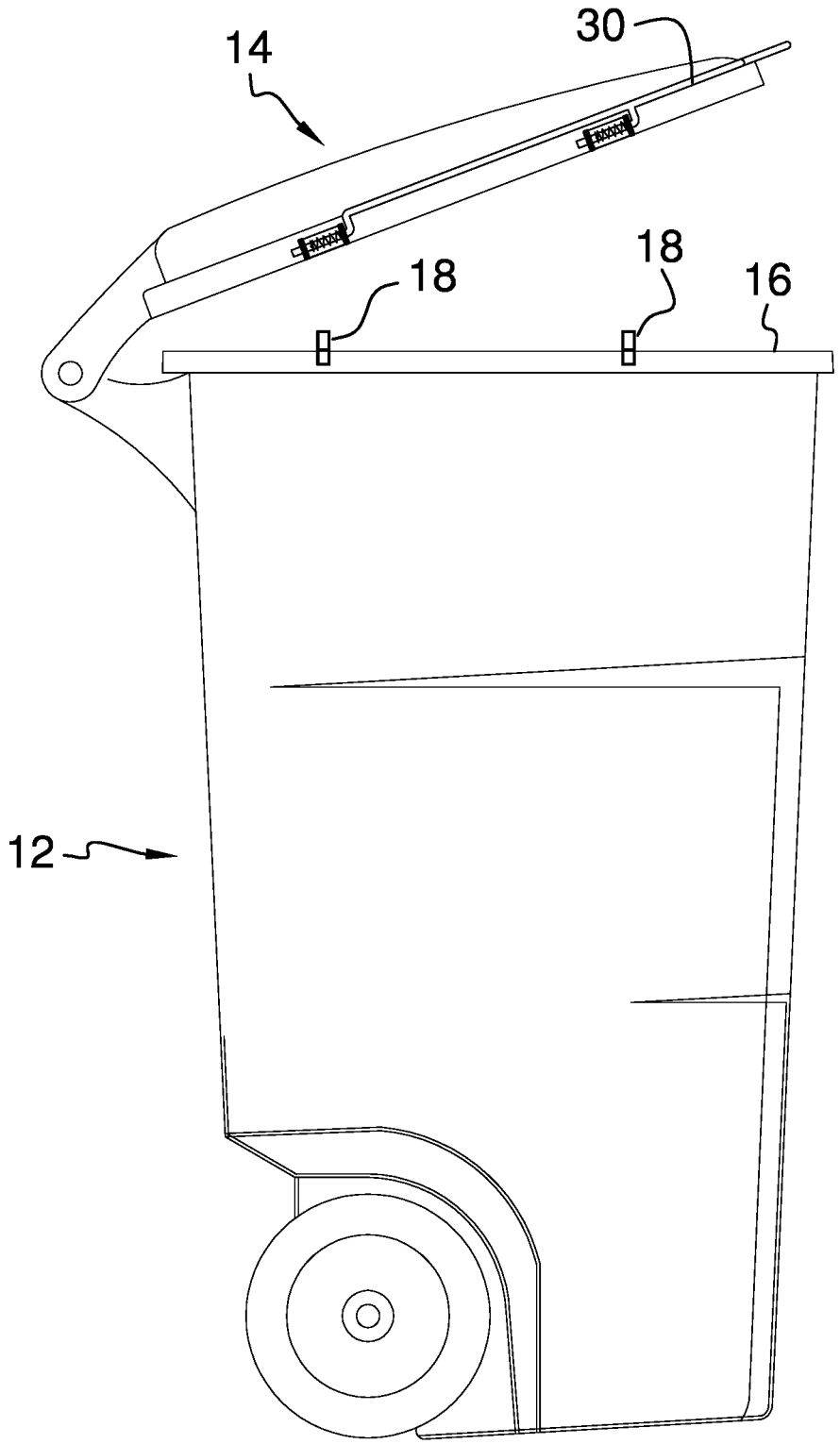
FIG. 4 is a right side in-use view of an embodiment of the disclosure showing a lid being unlocked.
Figure 5:
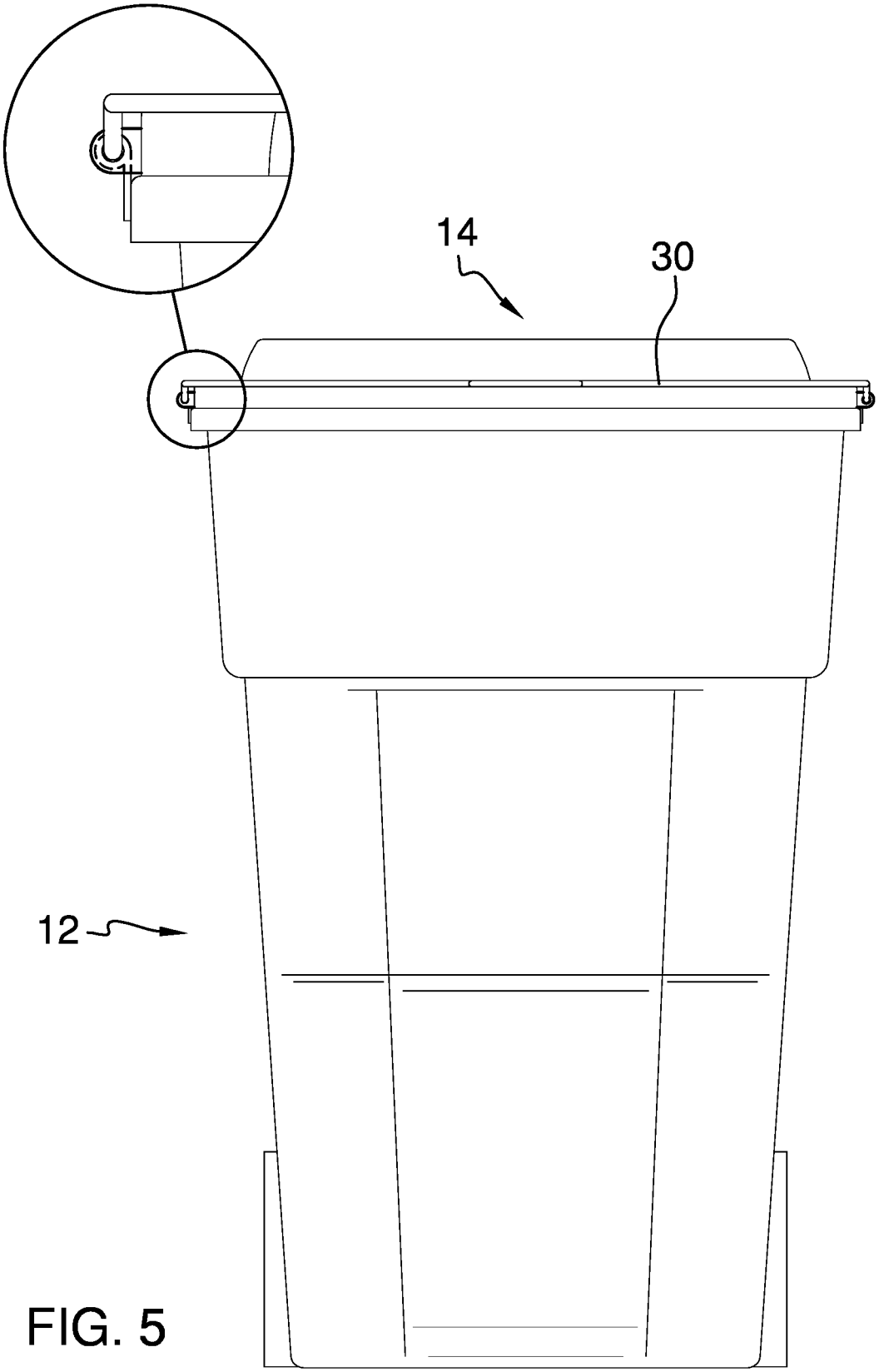
FIG. 5 is a front in-use view of an embodiment of the disclosure showing a rod engaging a receiver.
Figure 6:
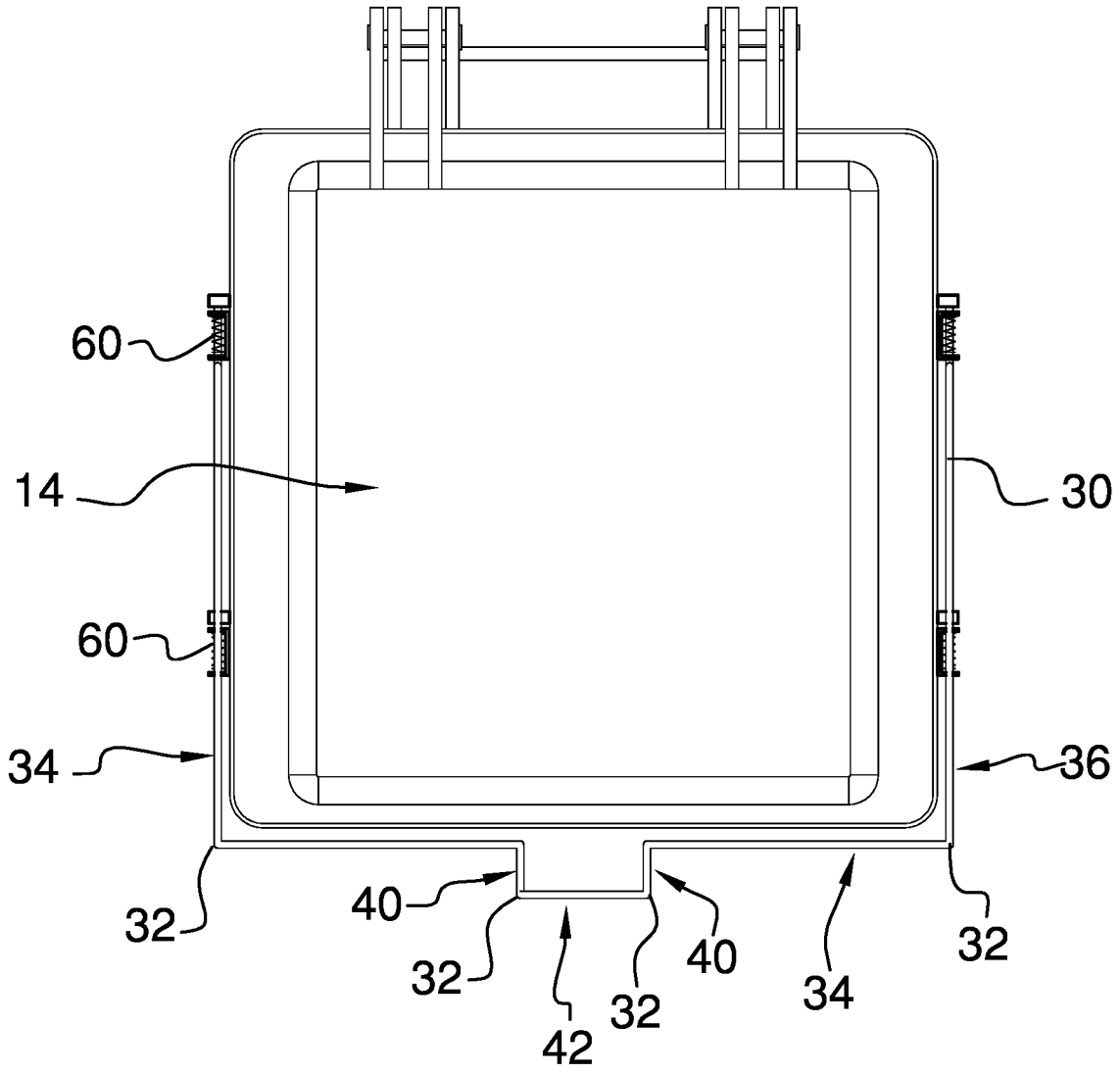
FIG. 6 is a top view of an embodiment of the disclosure.

With reference now to the drawings, and in particular to FIGS. 1 through 6 thereof, a new rubbish bin device embodying the principles and concepts of an embodiment of the disclosure and generally designated by the reference numeral 10 will be described.

As best illustrated in FIGS. 1 through 6, the rubbish bin lock assembly 10 generally comprises a rubbish bin 12 that has a lid 14 is hingedly to a top end 16 of the rubbish bin 12 for opening and closing the rubbish bin 12. The rubbish bin 12 may be an outdoor rubbish bin of any conventional design and size. A plurality of receivers 18 is provided and each of the receivers 18 is attached to the rubbish bin 12. Each of the receivers 18 is positioned adjacent to the top end 16 of the rubbish bin 12. Additionally, each of the receivers 18 has a sleeve portion 20 and a finger portion 21 extending downwardly from the sleeve portion 20. The sleeve portion 20 has an opening 22 extending through the sleeve portion 20, and the opening 22 in the sleeve portion 20 extends along an axis that is oriented perpendicular to a longitudinal axis of the finger portion 21. The finger portion 21 has a first surface 24 and a second surface 26, the sleeve portion 20 extends away from the second surface 26 and the first surface 24 is attached to an outer wall 28 of the rubbish bin 12.

A rod 30 is provided that has a sequence of bends 32 thereon to define a middle portion 34 of the rod 30 extending between a pair of outward portions 36 of the rod 30 such that the rod 30 defines a U-shape. In this way the rod 30 can be positioned around the lid 14 having each of the outward portions 36 of the rod 30 extending along respective lateral walls 38 of the lid 14 and having the middle portion 34 extending along a front wall of the lid 14. The sequence of bends 32 associated with the middle portion 34 defines a pair of first sections 40 that is each oriented perpendicular to the middle portion 34 and a second section 42 extending between the first sections 40 on a line oriented parallel to the middle portion 34. Moreover, the second section 42 is spaced from the front wall of the lid 14 when the rod 30 is positioned around the lid 14 such that the second section 42 can be gripped.

The rod 30 includes a plurality of engagements 44 that is each integrated into the rod 30. Each of the engagements 44 releasably engages a respective one of the receivers 18 when the lid 14 is in a closed position such that the plurality of engagements 44 locks the lid 14. In this way the plurality of engagements 44 inhibit animals, such as raccoons for example, from opening the lid 14. Each of the engagements 44 disengages the respective receiver 18 when the rod 30 is urged into an unlocked position thereby facilitating the lid 14 to be opened.

Each of the engagements 44 includes a leg 46 extending downwardly from a respective one of the outward portions 36 of the rod 30. Additionally, each of the engagements 44 includes a foot 48 that is oriented to extend along the respective outward portion 36. Respective ones of the engagements 44 are positioned on a distal end 50 of a respective one of the outward portions 36 of the rod 30. Respective ones of the engagements 44 are positioned between the distal end 50 of a respective outward portion 36 and the middle portion 34. The foot 48 of each of the engagements 44 slidably engages the opening 22 in the sleeve portion 20 of the respective receiver 18. Additionally, the foot 48 of each of the engagements 44 has a stop 52 that is integrated into the foot 48 and the stop 52 is spaced from the leg 46 of a respective engagement 44.

A plurality of slides 54 is provided and each of the slides 54 is attached to the lid 14. Each of the slides 54 slidably engages a respective one of the engagements 44 such that the rod 30 is slidably retained on the lid 14. Each of the slides 54 includes a pair of lobes 56 extending away from a panel 58. The foot 48 of the respective engagement 44 slides through each of the lobes 56 of the slides 54. Moreover, the panel 58 of each of the slides 54 is coupled to a respective one of the lateral walls 38 of the lid 14.

A plurality of biasing members 60 is provided and each of the biasing members 60 is positioned around the foot 48 of a respective one of the engagements 44. Each of the biasing members 60 extends between the stop 52 on the foot 48 of the respective engagement 44 and a respective one of the lobes 56 through which the foot 48 of the respective engagement 44 extends. Each of the biasing members 60 is compressed between the stop 52 and the respective lobe 56 when the rod 30 is urged into the unlocked position. Each of the biasing members 60 biases the stop 52 away from the respective lobe 56 such that the foot 48 of the respective engagement 44 is urged to extend fully through the respective slide 54.

In use, the second section 42 of the middle portion 34 of the rod 30 is gripped and the rod 30 is urged into the unlocked position. In this way each of the engagements 44 disengages from the respective receiver 18 to facilitate the lid 14 to be opened. Each of the engagements 44 is biased to engage the respective receiver 18 when the lid 14 is closed. In this way the rod 30 inhibits the lid 14 from being opened without first urging the rod 30 into the unlocked position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rubbish bin lock assembly for locking a lid on a rubbish bin, said assembly comprising:

a rubbish bin having a lid being hingedly to a top end of said rubbish bin for opening and closing said rubbish bin;

a plurality of receivers, each of said receivers being attached to said rubbish bin, each of said receivers being positioned adjacent to said top end of said rubbish bin;

a rod having a sequence of bends thereon to define a middle portion of said rod extending between a pair of outward portions of said rod such that said rod defines a U-shape thereby facilitating said rod to be positioned around said lid, said rod having a plurality of engagements each being integrated into said rod, each of said engagements releasably engaging a respective one of said receivers when said lid is in a closed position such that said plurality of engagements locks said lid wherein said plurality of engagements is configured to inhibit animals from opening said lid, each of said engagements disengaging said respective receiver when said rod is urged into an unlocked position thereby facilitating said lid to be opened;

a plurality of slides, each of said slides being attached to said lid, each of said slides slidably engaging a respective one of said engagements such that said rod is slidably retained on said lid; and wherein each of said receivers has a sleeve portion and a finger portion extending downwardly from said sleeve portion, said sleeve portion having an opening extending through said sleeve portion, said opening in said sleeve portion extending along an axis being oriented perpendicular to a longitudinal axis of said finger portion, said finger portion having a first surface and a second surface, said sleeve portion extending away from said second surface, said first surface being attached to an outer wall of said rubbish bin.

2. A rubbish bin lock assembly for locking a lid on a rubbish bin, said assembly comprising:

a rubbish bin having a lid being hingedly to a top end of said rubbish bin for opening and closing said rubbish bin;

a plurality of receivers, each of said receivers being attached to said rubbish bin, each of said receivers being positioned adjacent to said top end of said rubbish bin;

a rod having a sequence of bends thereon to define a middle portion of said rod extending between a pair of outward portions of said rod such that said rod defines a U-shape thereby facilitating said rod to be positioned around said lid, said rod having a plurality of engagements each being integrated into said rod, each of said engagements releasably engaging a respective one of said receivers when said lid is in a closed position such that said plurality of engagements locks said lid wherein said plurality of engagements is configured to inhibit animals from opening said lid, each of said engagements disengaging said respective receiver when said rod is urged into an unlocked position thereby facilitating said lid to be opened;

a plurality of slides, each of said slides being attached to said lid, each of said slides slidably engaging a respective one of said engagements such that said rod is slidably retained on said lid; and wherein each of said outward portions of said rod extends along respective lateral walls of said lid, said middle portion extending along a front wall of said lid, said sequence of bends associated with said middle portion defines a pair of first sections each being oriented perpendicular to said middle portion and a second section extending between said first sections on a line being oriented parallel to said middle portion, said second section being spaced from said front wall of said lid when said rod is positioned around said lid wherein said second section configured to be gripped.

3. A rubbish bin lock assembly for locking a lid on a rubbish bin, said assembly comprising:

a rubbish bin having a lid being hingedly to a top end of said rubbish bin for opening and closing said rubbish bin;

a plurality of receivers, each of said receivers being attached to said rubbish bin, each of said receivers being positioned adjacent to said top end of said rubbish bin;

a rod having a sequence of bends thereon to define a middle portion of said rod extending between a pair of outward portions of said rod such that said rod defines a U-shape thereby facilitating said rod to be positioned around said lid, said rod having a plurality of engagements each being integrated into said rod, each of said engagements releasably engaging a respective one of said receivers when said lid is in a closed position such that said plurality of engagements locks said lid wherein said plurality of engagements is configured to inhibit animals from opening said lid, each of said engagements disengaging said respective receiver when said rod is urged into an unlocked position thereby facilitating said lid to be opened;

a plurality of slides, each of said slides being attached to said lid, each of said slides slidably engaging a respective one of said engagements such that said rod is slidably retained on said lid; and wherein each of said engagements includes a leg extending downwardly from a respective one of said outward portions of said rod, each of said engagements including a foot being oriented to extend along said respective outward portion.

4. The assembly according to claim 3, wherein:

each of said receivers has a sleeve portion and a finger portion extending downwardly from said sleeve portion, said sleeve portion having an opening extending through said sleeve portion, said opening in said sleeve portion extending along an axis being oriented perpendicular to a longitudinal axis of said finger portion, said finger portion having a first surface and a second surface, said sleeve portion extending away from said second surface, said first surface being attached to an outer wall of said rubbish bin; and respective ones of said engagements is positioned on a distal end of a respective one of said outward portions of said rod, respective ones of said engagements being positioned between said distal end of a respective outward portion and said middle portion, said foot of each of said engagements slidably engaging said opening in said sleeve portion of said respective receiver, said foot of each of said engagements having a stop being integrated into said foot, said stop being spaced from said leg of a respective engagement.

5. The assembly according to claim 4, wherein each of said slides includes a pair of lobes extending away from a panel, said foot of said respective engagement sliding through each of said lobes of said slides, said panel of each of said slides being coupled to a respective one of said lateral walls of said lid.

6. The assembly according to claim 5, further comprising a plurality of biasing members, each of said biasing members being positioned around said foot of a respective one of said engagements, each of said biasing members extending between said stop on said foot of said respective engagement and a respective one of said lobes through which said foot of said respective engagement extends, each of said biasing members being compressed between said stop and said respective lobe when said rod is urged into said unlocked position, each of said biasing members biasing said stop away from said respective lobe such that said foot of said respective engagement is urged to extend fully through said respective slide.

7. The rubbish bin lock assembly of claim 1, said assembly further comprising:

each of said outward portions of said rod extending along respective lateral walls of aid d, said middle portion extending along a front wall of said lid, said sequence of bends associated with said middle portion defining a pair of first sections each being oriented perpendicular to said middle portion and a second section extending between said first sections on a line being oriented parallel to said middle portion, said second section being spaced from said front wall of said lid when said rod is positioned around said lid wherein said second section configured to be gripped, each of said engagements including a leg extending downwardly from a respective one of said outward portions of said rod, each of said engagements including a foot being oriented to extend along said respective outward portion, respective ones of said engagements being positioned on a distal end of a respective one of said outward portions of said rod, respective ones of said engagements being positioned between said distal end of a respective outward portion and said middle portion, said foot of each of said engagements slidably engaging said opening in said sleeve portion of said respective receiver, said foot of each of said engagements having a stop being integrated into said foot, said stop being spaced from said leg of a respective engagement;

each of said slides including a pair of lobes extending away from a panel, said foot of said respective engagement sliding through each of said lobes of said slides, said panel of each of said slides being coupled to a respective one of said lateral walls of said lid; and a plurality of biasing members, each of said biasing members being positioned around said foot of a respective one of said engagements, each of said biasing members extending between said stop on said foot of said respective engagement and a respective one of said lobes through which said foot of said respective engagement extends, each of said biasing members being compressed between said stop and said respective lobe when said rod is urged into said unlocked position, each of said biasing members biasing said stop away from said respective lobe such that said foot of said respective engagement is urged to extend fully through said respective slide.

* * * * *